US008225735B1

(12) United States Patent
Galway

(10) Patent No.: US 8,225,735 B1
(45) Date of Patent: Jul. 24, 2012

(54) CONTEMPORANEOUS LATCHING AND FUELING ARRANGEMENT FOR FUELING A WATER VESSEL

(75) Inventor: Robert J. Galway, Virginia Beach, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 441 days.

(21) Appl. No.: 12/537,376

(22) Filed: Aug. 7, 2009

Related U.S. Application Data

(63) Continuation-in-part of application No. 12/079,063, filed on Mar. 3, 2008, now Pat. No. 8,020,505.

(60) Provisional application No. 61/268,655, filed on May 19, 2009.

(51) Int. Cl.
*B63B 21/56* (2006.01)
*B63B 21/58* (2006.01)

(52) U.S. Cl. ..... 114/242; 114/249; 114/250; 114/253

(58) Field of Classification Search ..... 114/242, 114/244, 245, 248–253, 258, 322
See application file for complete search history.

(56) References Cited

U.S. PATENT DOCUMENTS

| | | | | |
|---|---|---|---|---|
| 2,345,816 | A | 4/1944 | Hays | |
| 2,956,532 | A * | 10/1960 | James et al. | 114/254 |
| 2,963,179 | A * | 12/1960 | Woods et al. | 414/139.5 |
| 3,735,722 | A | 5/1973 | Hooper et al. | |
| 3,943,875 | A * | 3/1976 | Sanders | 114/244 |
| 4,286,537 | A | 9/1981 | Hvide | |
| 4,356,784 | A | 11/1982 | Waters et al. | |
| 6,336,419 | B1 | 1/2002 | Breivik | |
| 6,883,453 | B1 * | 4/2005 | Mulhern | 114/253 |
| 7,025,014 | B1 * | 4/2006 | Forgach et al. | 114/244 |
| 7,156,036 | B2 * | 1/2007 | Seiple | 114/254 |
| 7,506,606 | B2 * | 3/2009 | Murphy et al. | 114/368 |
| 7,699,015 | B1 * | 4/2010 | Said | 114/253 |
| 8,020,505 | B1 * | 9/2011 | Galway | 114/249 |

OTHER PUBLICATIONS

Galway, Robert , "Autonomous Refueling of Unmanned Vehicles at Sea", Non-Patent Literature; May 19, 2008.

* cited by examiner

*Primary Examiner* — Ajay Vasudeva
(74) *Attorney, Agent, or Firm* — Dave A. Ghatt

(57) ABSTRACT

A method and apparatus for securing and fueling a surface water vessel at a fueling block, connected to and remote from a parent ship. The surface water vessel may be a manned or an unmanned surface vehicle, for example. According to the invention, the surface water vessel includes a probe for securing the water vessel to the fueling block and also for receiving fuel from the parent ship at the fueling block. The fueling block includes an opening for receiving the probe therein.

5 Claims, 8 Drawing Sheets

FIG. 4C
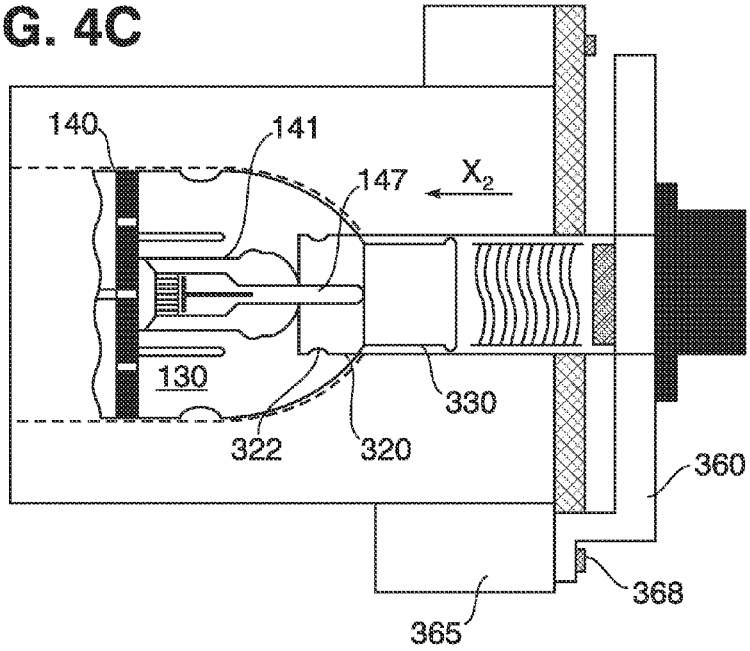
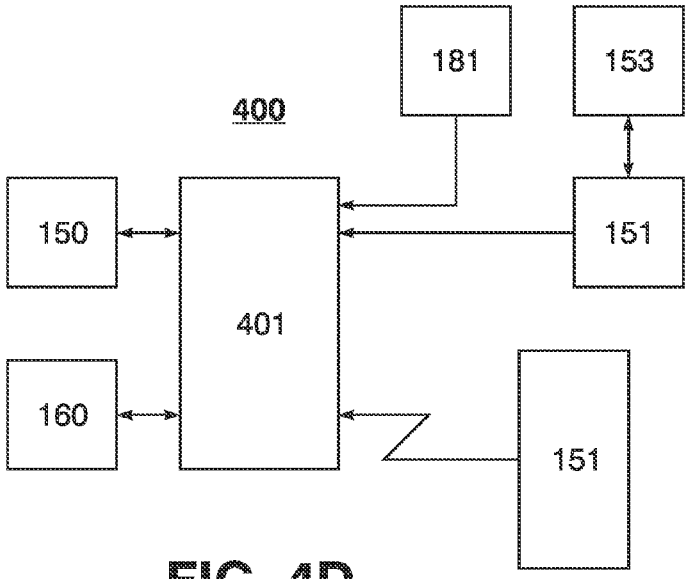
FIG. 4D

CONTEMPORANEOUS LATCHING AND FUELING ARRANGEMENT FOR FUELING A WATER VESSEL

CROSS-REFERENCE TO RELATED APPLICATIONS

This application is a continuation-in-part of U.S. nonprovisional patent application Ser. No. 12/079,063, now U.S. Pat. No. 8,020,505 hereby incorporated by reference, entitled, "Probe Receiver Device for Recovering Surface Water Vessels," filed Mar. 3, 2008. This application claims the benefit of U.S. Provisional Application No. 61/268,655, filed May 19, 2009.

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to a method and apparatus for fueling a surface water vessel, and in particular, an arrangement for the contemporaneous latching and fueling of a surface water vessel at a location that is remote from a parent ship.

BACKGROUND

The recovery of smaller surface water vessels, such as manned or unmanned surface water vessels (USVs), by larger parent ships is an emerging technology. Once recovered by the parent ship, servicing operations such as fueling may be performed. Typically, the recovery of a smaller vessel is accomplished by driving the smaller vessel alongside a stationary parent ship and lifted by davit into the ship. Alternatively, the smaller water vessel may be driven up a ramp into the larger ship.

Traditional methods of capturing smaller surface water vessels can cause damage to the hull of the smaller vessel. For example, some USVs weigh about 20,000 lbs and are made from materials such as aluminum. A capturing method that for example, requires the USV to be driven into a parent ship or be lifted and dropped onto the parent ship can cause damage to the aluminum hull, resulting in expensive repairs. The prior art does not teach a method and apparatus that captures the smaller vessel in a controlled manner away from direct contact with the parent ship in order to perform servicing operations such as fueling.

SUMMARY

In one aspect, the invention is a fueling system for securing and fueling a water vessel at a floating station. In this aspect, the fueling system includes a parent ship for supplying fuel, and a fuel conduit having a first end and a second end. The fuel conduit is attached to the parent ship at the first end. The system further includes a floating station, remote from the parent ship. The second end of the fuel conduit is attached to the floating station for transporting fuel from the parent ship to the floating station. The floating station includes an opening for receiving a probe. In this aspect, the system further includes a water vessel with a probe, with the probe positioned within the opening of the floating station. The probe receives fuel from the parent ship via the fuel conduit and the floating station.

In another aspect, the invention is a latching and fueling arrangement for securing and fueling a water vessel. The latching and fueling arrangement includes a water vessel. The water vessel includes a vessel hull, an elongated probe having a probe head section. The elongated probe is attached to the vessel hull. In this aspect, the invention further includes a fueling block. The fueling block having an elongated opening for receiving the elongated probe, a clamping arrangement for latching the probe, and a displaceable fuel-feeding cylinder. In this aspect, when the elongated probe is latched in the elongated opening, the fuel-feeding cylinder is slidable into and out of the head section of the elongated probe.

In another aspect, the invention is a method of servicing a water vessel. The method includes the providing of a parent ship with a fuel supply. The method further includes providing a fueling block remote from the parent ship. In this aspect, the method further includes providing a fuel-feeding line from the parent ship to the fueling block, and directing the water vessel to the fueling block. The method further includes securing the water vessel to the fueling block by inserting a fuel-receiving probe into the fueling block.

BRIEF DESCRIPTION OF THE DRAWINGS

Other features will be apparent from the description, the drawings, and the claims.

FIGS. 4A-4C are exemplary illustrations of a probe/block arrangement at different stages of latching and fueling, according to an embodiment of the invention.

FIG. 4D is a schematic illustration of a controller arrangement according to an embodiment of the invention.

DETAILED DESCRIPTION

Figure 1A:
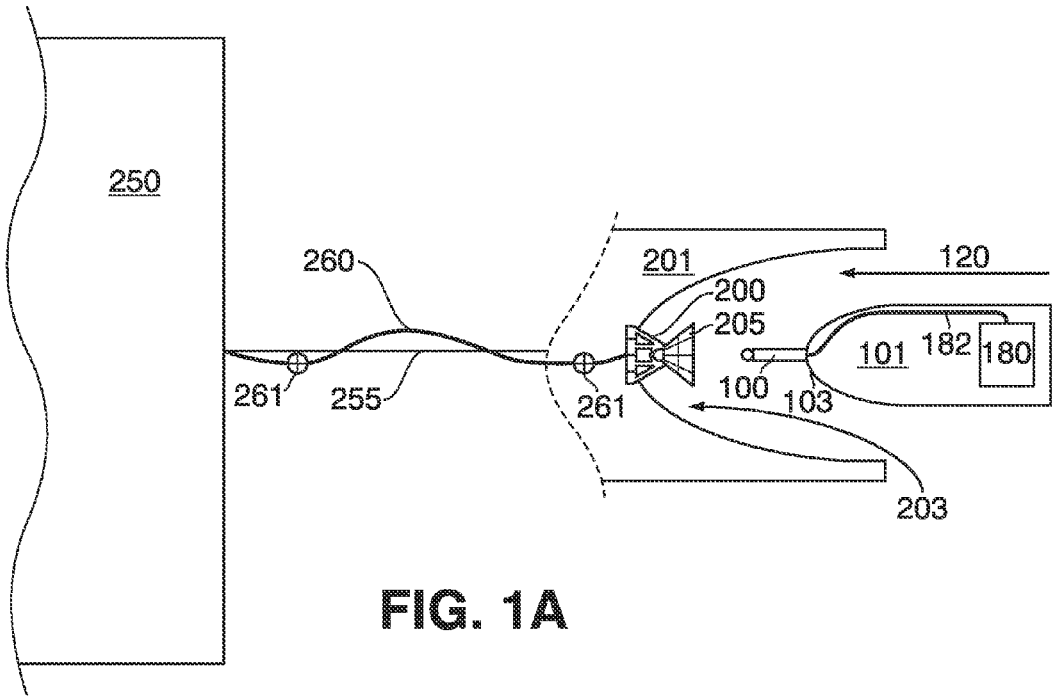
FIG. 1A is a schematic illustration of a latching and fueling arrangement for securing and fueling a water vessel at a floating station according to an embodiment of the invention.

FIG. 1A is an exemplary illustration of a latching and fueling arrangement for securing and fueling a surface water vessel 101 to a floating station 201 according to an embodiment of the invention. The arrangement also includes a parent ship 250, which is typically a larger water vessel, such as a sea base which transports smaller vessels such as water vessels 101 and the like. FIG. 1A schematically shows the surface water vessel 101, which may be a manned or an unmanned surface vessel having a forwardly projecting elongated probe 100 at the bow 103 of the water vessel 101. As will be outlined below, the probe 100 may be pivotally attached at the bow 103, where it pivots between a stowed position and a deployed position. The probe 100 is used to secure the water vessel 101 to the floating vessel 201. As outlined below, if desired, fuel may be supplied to the water vessel 101 through the probe 100. FIG. 1A also shows the water vessel 101 having a fuel collection device 180, such as a gas tank. The fuel collection device 180 may be attached via a hose 182, within the vessel hull, to the probe 100.

FIG. 1A shows the floating station 201 of the latching and fueling arrangement having a substantially V-shaped receiving portion 203 for guiding and receiving the bow end of water vessels towards a conical front/funnel shaped member 205. FIG. 1A also shows the floating station 201 having a latching and fueling block 200 at an apex of the substantially V-shaped receiving portion 203. As shown, the funnel-shaped member 205 may be attached to the fueling block 200 to guide the probe 100 into the block 200. The fueling block 200 may be attached to the floating station 201 in an integral manner, or may be retrofitted using one or more attachment devices such as clamps, struts, and the like. The floating station 201 may be a solid structure or an inflated structure, and may have any desired shape, such as for example, rectangular, oval, oblong, circular, or irregular. The floating station 201 preferably has a weight and dimensions that allows it to ably support an attached water vessel 101. When the floating station 201 is an inflated structure, the body may be made from a material such as natural rubber, urethane rubber, fluororubber, silicone rubber, elastomers, plastics, and the like.

FIG. 1A shows the floating station 201 connected to the parent ship 250 by a tow line 255. FIG. 1A also shows a fuel conduit/line 260 such as a hose, running from the parent ship 250 to the fueling block 200 of the floating station 201. As outlined below, the conduit 260 delivers fuel from the parent ship 250 to the floating station 201, where vessels such as water vessel 101 are supplied with the fuel. The fuel conduit is equipped with one or more valves 261 for controlling the flow of fuel to the floating station 201 and to the water vessel 101. The valves 261 may lock off the flow of fuel in circumstances when the conduit 260 fails, thereby preventing undue spillage of fuel into the surrounding water. According to the invention, the water vessel 101 may be supplied with fuel only after the probe 100 is fully inserted and secured in the fueling block 200 of the floating station. FIG. 1A shows arrow 120 indicating the direction in which the water vessel 101 flows with respect to the floating station 201, in order to be secured therewithin.

Figure 1B:
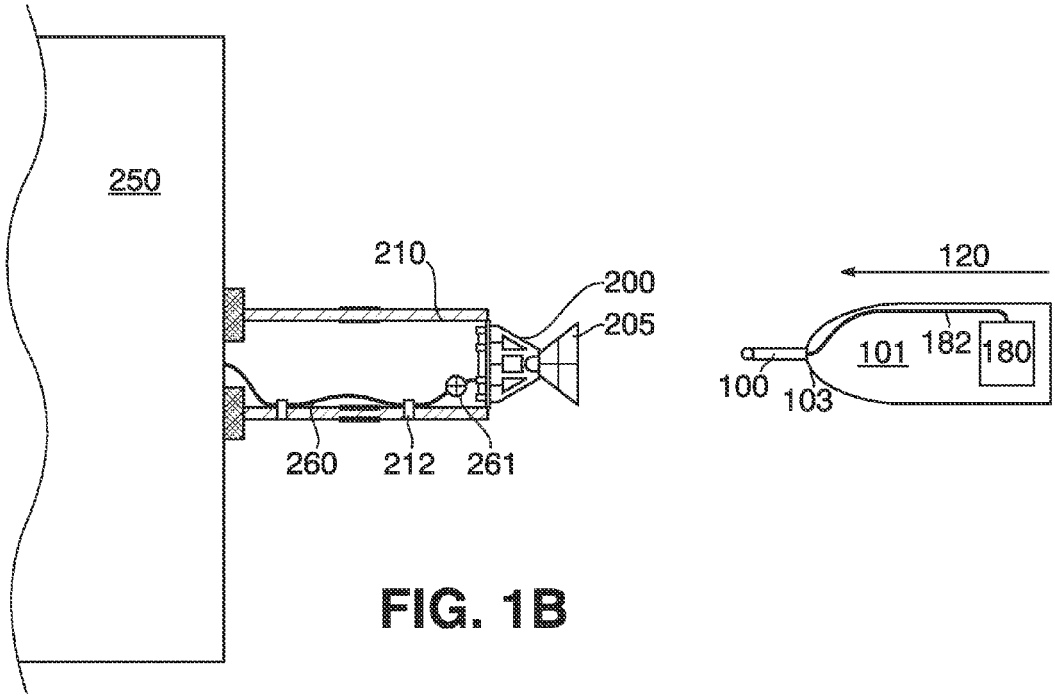
FIG. 1B is a schematic illustration of a latching and fueling arrangement for securing and fueling a water vessel, according to an embodiment of the invention.

FIG. 1B is an exemplary illustration of a latching and fueling arrangement for securing and fueling a surface water vessel 101, according to an embodiment of the invention. The arrangement of FIG. 1B is similar to that of FIG. 1A, except the FIG. 1B arrangement does not include a floating station 201. FIG. 1B is also fueled at a fueling block 200 which receives fuel from the parent ship 250 via a conduit 260. The fueling block 200 may be attached to the parent ship 250 by one or more swinging arms 210. When not deployed, the arms 210 may be held substantially upright against the hull of the parent ship 250. When deployed, the one or more arms 210 may swing down to place the block 200 in a position at the water surface that allows the block 200 to receive the probe 100 of the water vessel 101. FIG. 1B shows holders 212 that may be used to clip the conduit 260 to an arm 210. Regarding the description of elements represented in FIGS. 1A, 1B, and other figures, it should be noted that similarly numbered elements operated similarly.

Figure 2A:
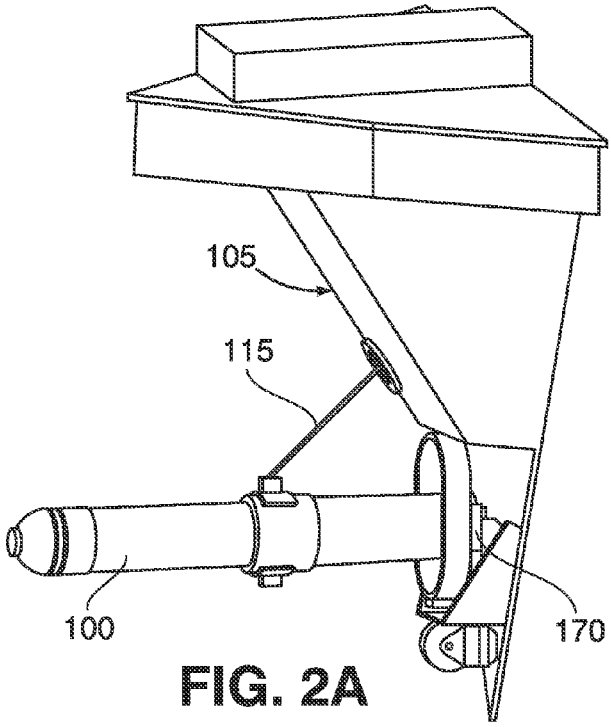
FIG. 2A is an exemplary illustration of an elongated probe extended at the bow of a water vessel, according to an embodiment of the invention.
Figure 2B:
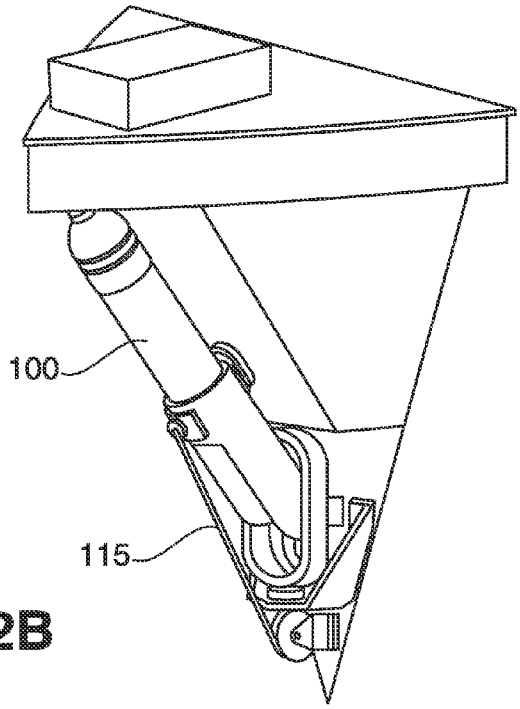
FIG. 2B is an exemplary illustration of an elongated probe retracted at the bow of a water vessel, according to an embodiment of the invention.

FIGS. 2A and 2B are an exemplary illustrations of the elongated probe 100 positioned at the bow 105 of the water vessel 101, according to an embodiment of the invention. FIG. 2A shows the probe 100 in a forwardly extending position and FIG. 2B shows the probe in a retracted position. In the forwardly extending position of FIG. 2A, the probe 100 is oriented for insertion into the fueling block 200 of the floating station 201. When not in use, the probe 100 may be stored in the retracted position shown in FIG. 2B. FIGS. 2A and 2B shows that cable 115 may be used to facilitate the pivoting movement of the probe 100 between the forwardly extending position and the retracted position. The probe 100 pivots about a connection element in the base section 170. It should be noted that instead of the cable 115, alternative mechanical attachments, such as pneumatic arms for example, may be used to manipulate the movement of the probe 100.

Figure 2C:
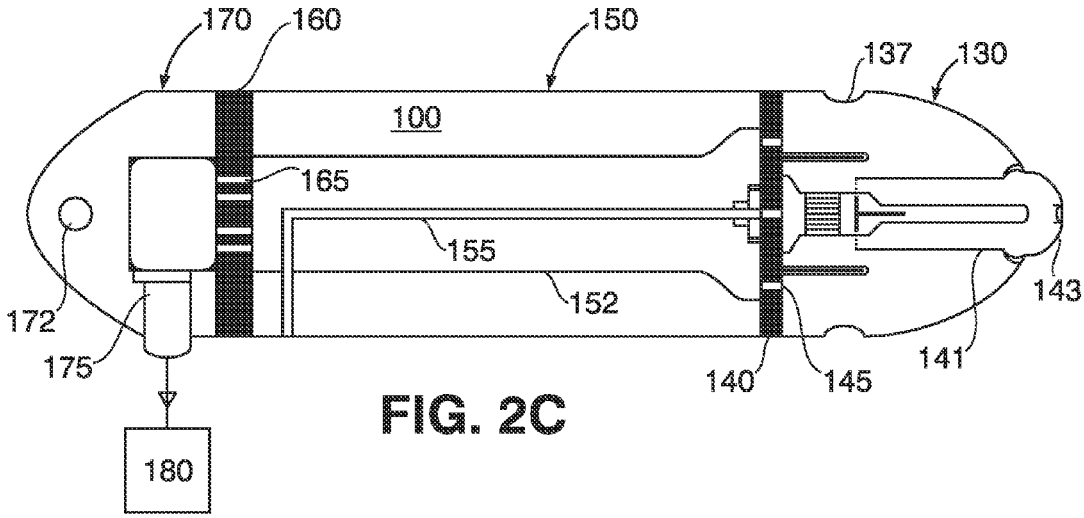
FIG. 2C is an exemplary sectional illustration of an elongated probe, according to an embodiment of the invention.

FIG. 2C is an exemplary sectional illustration of the elongated probe 100, according to an embodiment of the invention. As shown, the probe 100 includes a head section 130, a middle flow section 150, and a connection base section 170. Fuel initially enters the probe 100 via the head section 130, which also serves to securely fasten the water vessel 101 to the floating station 201. Elements of the head section 130 are outlined below.

The middle flow section 150, transmits fuel from the head section 130 to the connection base section 170. The fuel enters the middle flow section 150 via entry holes 145 in a first separation ring 140. Flow section 150 includes an elongated fuel channel 152, which receives fuel from the entry holes 145. The channel 152 extends from the first separation ring 140 to a second separation ring 160, which separates the middle flow section 150 from the connection base section 170. The separation ring 160 may also include one or more holes 165 allowing fuel to travel from the middle flow section 150 to the base section 170. The channel 152 in the middle flow section 150 may have a narrowing diameter as the channel 152 extends from the first separation ring 140 to the second separation ring 160. FIG. 2C also shows an insulated conduit 155, for insulating wiring and other electronic elements from the fuel and other undesired elements.

FIG. 2C also shows the connection base section 170, from which fuel flows to the fuel collection device 180. A piping arrangement 175, which may be elbow shaped, may be used to receive fuel through the one or more holes 165 in the second separation ring 160, and to direct the fuel towards the fuel collection device 180 by means of the hose 185. As illustrated, the connection base section 170, also includes a connection element 172 for pivotally connecting the probe to the bow of the water vessel.

Figure 2D:
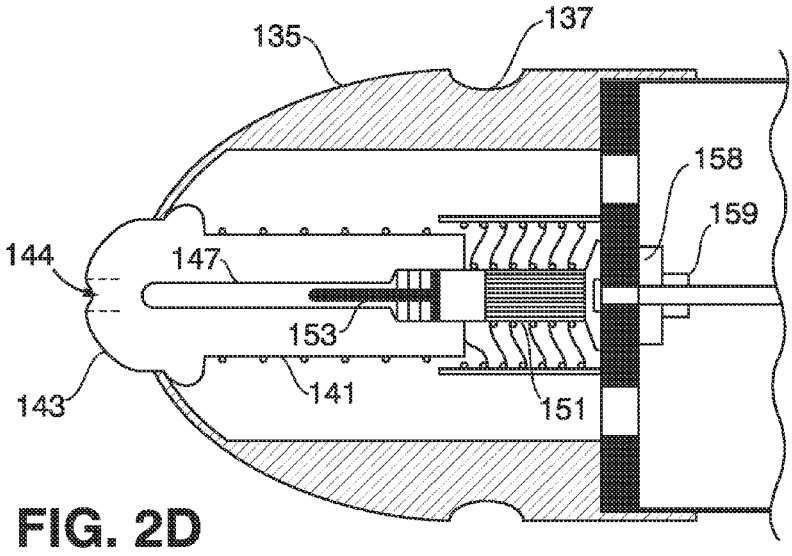
FIG. 2D is an exemplary sectional illustration of the head section of the elongated probe, according to an embodiment of the invention.
Figure 2E:
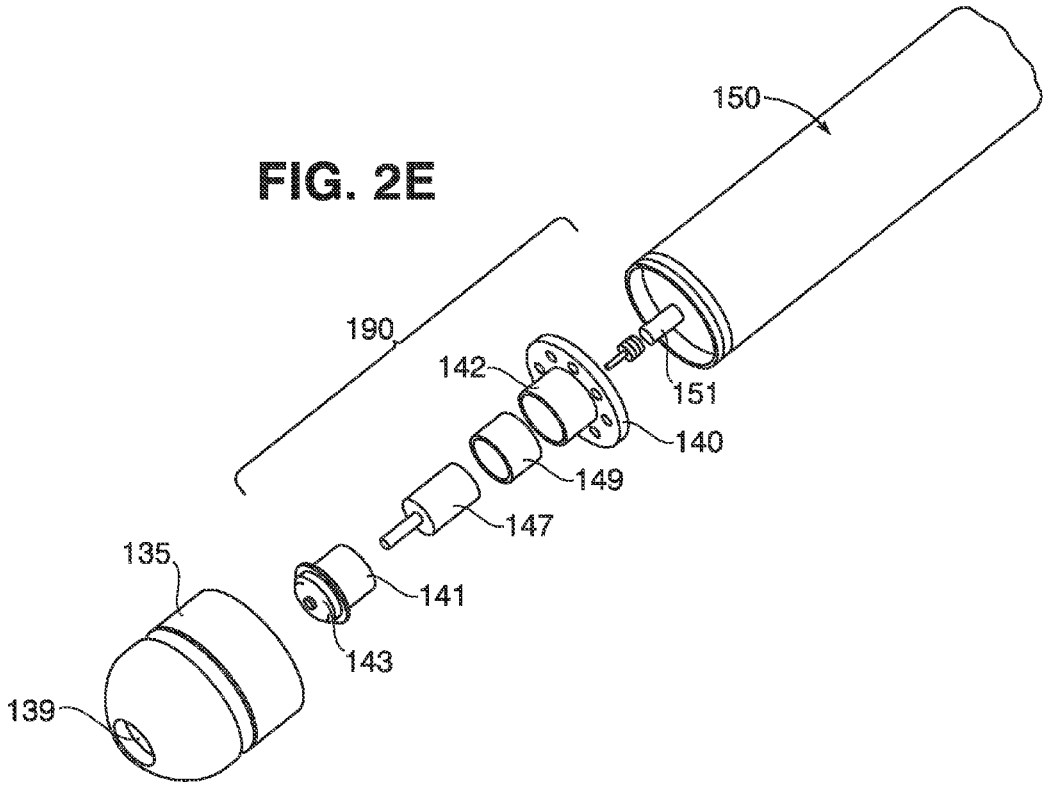
FIG. 2E is an exemplary exploded illustration of the head section of the elongated probe, according to an embodiment of the invention

FIG. 2D is an exemplary sectional illustration of the head section 130 of the elongated probe 100, according to an embodiment of the invention. FIG. 2E provides an exemplary exploded illustration of the head section 130 of the elongated probe 100. As shown, the head portion 130 includes a cover 135 which encases other elements of the head section 130 therewithin. The cover 135 includes a circumferential channel 137 by which the probe 100 is secured. As outlined below, securing devices associated with the fueling block 200 extend into the channel 137, thereby securing the probe 100 to the floating station 201.

FIGS. 2D and 2E also show a contact cap 141, a push rod 147, a spring 149, the first separation ring 140 having a hollow cylindrical projection 142, and a detecting arrangement including elements 151 and 153, which are positioned as shown in FIG. 2D, forming a sensing and fuel regulating device 190. As shown in FIG. 2D, the spring 149 is housed within the hollow cylindrical projection 142. The push rod 147 is partially housed within the hollow cylindrical projection 142, with the upper portion of the push rod 148 extending to an opening in the cover 139. FIG. 2D also shows the detecting arrangement in which elements 151 and 153 are housed within the push rod 147. Element 153 may be an axially displaceable plunger that is normally biased towards the tip of the probe 100. Element 151 may be a fixed proximity sensor having external threads that are screwed into a receptacle within the push rod 147. Wires connected to element 151 extend into the conduit 155 for proper insulation. Detections are made based on the relative position of the biased plunger element 153 with respect to the proximity element 151.

The contact cap 141 has an upper lip portion 143 which protrudes through the opening 139 at the top of the cover 135. FIG. 2D also shows through-hole 144 in cap 141, through which the push rod 147 may extend. As outlined below, when the probe 100 extends into the fueling block 200 of the floating station 201, proper insertion of the probe 100 is detected when the upper lip portion 143 of the contact cap 141 initially contacts and is pushed back by a valve arrangement within the block 200. This motion overcomes the loaded spring bias on the plunger 153, and the plunger element 153 is forced away form the probe tip towards the proximity element 151. Proper insertion is detected based on the location of element 153 with respect to element 151.

Figure 3A:
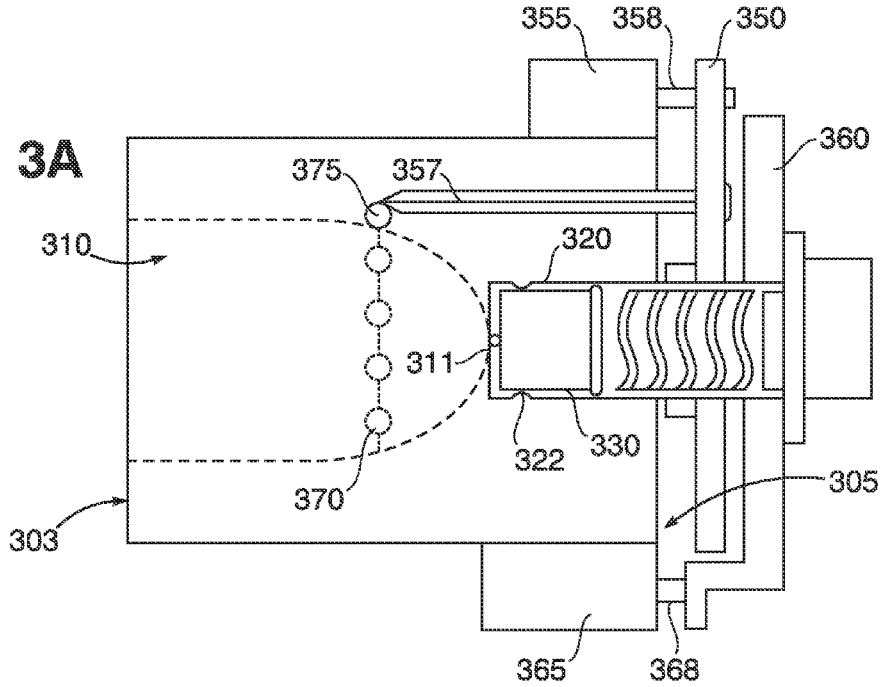
FIG. 3A is an exemplary schematic sectional illustration of a fueling block according to an embodiment of the invention.

FIG. 3A is an exemplary sectional illustration of a fueling block 200 according to an embodiment of the invention. As shown, the fueling block 200 includes a front end 303 and a rear end 305. The front end 303 includes an elongated opening 310 for receiving a probe 100. Thus, the elongated opening 310 has a shape that is substantially similar to the shape of a probe 100. As shown in FIGS. 1A and 1B, funnel-shaped/conical member 205 may be attached to the fueling block 200 to guide the probe 100 into the block 200. FIG. 3A also shows a fuel-feeding cylinder 320 positioned at an innermost apex location 311 of the elongated opening 310. When the probe 100 is inserted into the fueling block 200, the apex location 311 receives the tip portion of the probe.

Figure 3B:
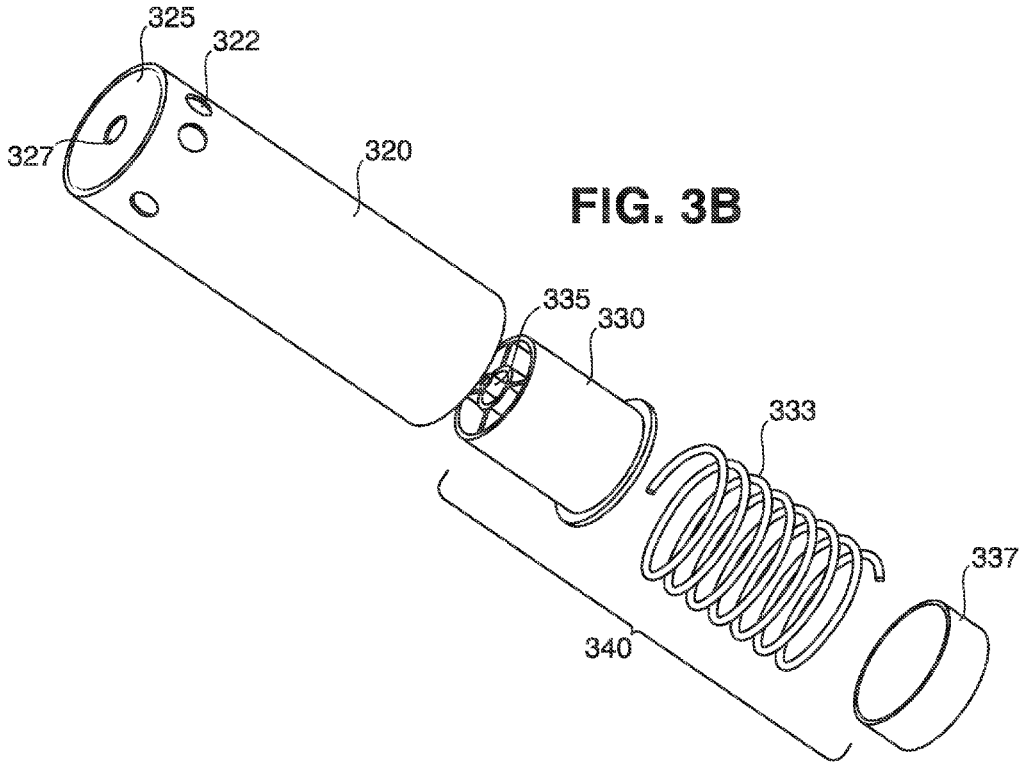
FIG. 3B is an exemplary exploded illustration of a fuel-feeding cylinder and valve arrangement of a fueling block according to an embodiment of the invention.

FIG. 3B is an exemplary exploded illustration of the fuel-feeding cylinder 320 of a fueling block 320, and a valve arrangement 340 for the cylinder 320, according to an embodiment of the invention. As will be outlined below, fuel is fed into the probe 100 through the fuel-feeding cylinder 320. FIG. 3B shows the fuel-feeding cylinder 320 having fuel-feeding openings 322 at the top end, through which the fuel is fed to the probe 100. As shown, the top end of the fuel-feeding cylinder 320 is sealed with a concave surface 325. The concave surface 325 includes a through-hole 327, which as outlined above is for communicating with the push rod 147 of the probe 100.

FIGS. 3A and 3B also show a slidable cylindrical stopper 330, which is slidable within the fuel-feeding cylinder 320. The slidable cylindrical stopper 330 includes a protrusion tip 335 for penetrating the through the hole 327 of the fuel-feeding cylinder 320, for contacting the push rod 147 of the probe 100. The protrusion tip 335 and the push rod 147 may include mating grooves or ridges to enhance the contact therebetween. FIGS. 3A and 3B also show a spring 333 and a base ring 337, which combine to maintain a biasing force on the slidable cylindrical stopper 330. As outlined below, the slidable cylindrical stopper is slidable within the cylindrical fuel-feeding head 320 to block and to unblock the fuel-feeding openings 322. When the slidable cylindrical stopper 330 is in the location illustrated in FIG. 3A, the fuel-feeding openings are blocked.

Figure 3C:
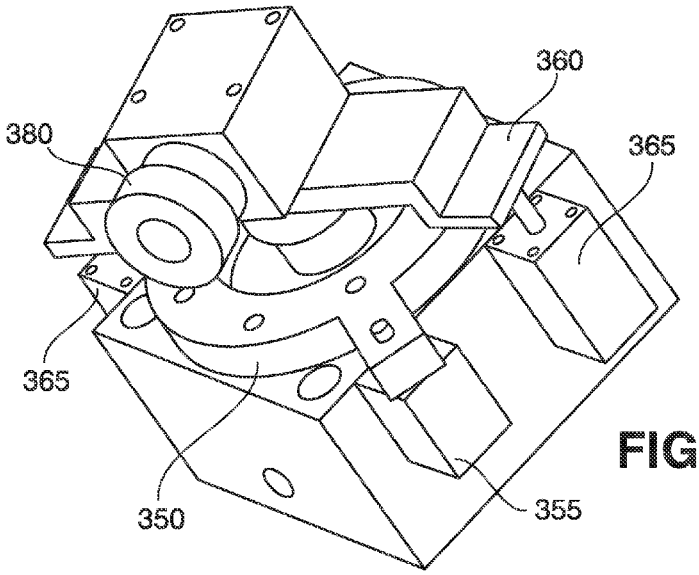
FIG. 3C is an exemplary perspective illustration of a fueling block according to an embodiment of the invention.

FIGS. 3A and 3C also show cross-mounts 350 and 360 attached to the rear end 305 of the fueling block 200. Cross-mount 350 is attached to a pair of hydraulic cylinders 355, one of which is shown in FIG. 3A. Similarly, cross-mount 360 is attached to a pair of hydraulic cylinder 365, one of which is shown in FIG. 3A. FIG. 3C, which provides a perspective view, shows both cylinders 365 of the pair, one at a top side of the block 200 and one at a bottom side of the block 200. FIG. 3C shows the first cross mount 350 having a ring-like shape, and the second cross-mount 360 having a planar bracket-like shape.

The first cross-mount 350 and hydraulic cylinder pair 355 are elements of a clamping arrangement for securing the probe within the elongated opening 310. The clamping arrangement also includes a plurality of tines 357 (one of which is shown in FIG. 3A), a plurality of lateral channels 370, and a plurality of movable holders, spheres or balls 375. The spheres 375 are radially displaceable by movement in the lateral channels 370. The hydraulic cylinder 355 is operatively attached to the plurality of tines 357. The operation of the hydraulic cylinders 355, the tines 357, the lateral channels 370, and the spheres 375 is similar to that as disclosed in U.S. patent application Ser. No. 12/079,063, entitled "Probe Receiver Device for Recovering Surface Water Vessels" which is incorporated herein by reference for all that it discloses. When the hydraulic cylinder 355 retracts, the tines 357 push the plurality of spheres 375 along the channels 370 into the circumferential channel 137 of the probe 100, thereby securely latching the elongated probe 100 within the block 200. Subsequent to locking, fuel may be supplied to the elongated probe 100. FIG. 3C shows a fuel port 380 that receives fuel from the parent ship 250 via the conduit 260 (shown in FIGS. 1A and 1B). When fueling is initiated, the fuel flows through the port 380 to the fuel-feeding cylinder 320. To initiate fueling, the second cross-mount 360 and hydraulic cylinder pair 365 communicate with the sensing and fuel regulating device 190 of the probe 100. As outlined below, the hydraulic cylinder pair 365 retracts and moves the fuel-feeding cylinder 320 into and out of the elongated probe 100, thereby regulating the flow of fuel into the probe 100.

Figure 4A:
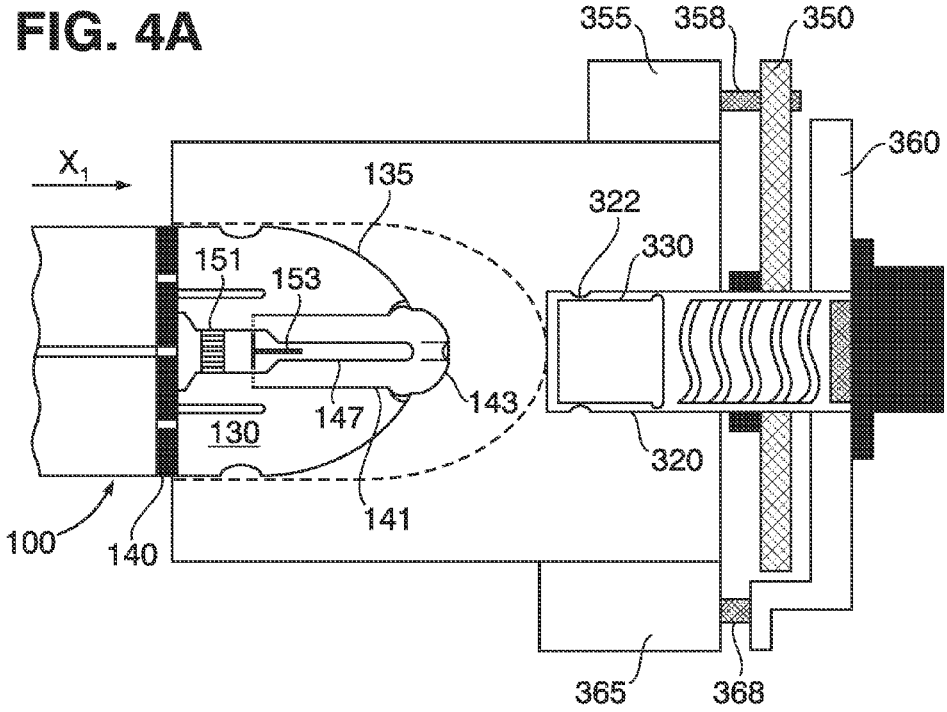
Figure 4B:
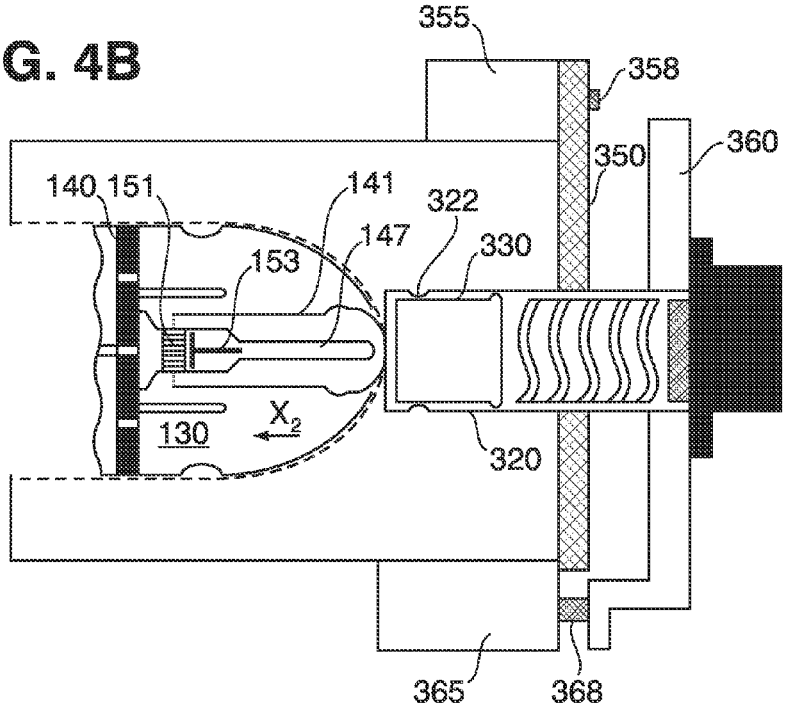

FIGS. 4A-4C are exemplary illustrations of a probe/block arrangement at different stages of the latching and fueling of a water vessel 101. The fueling and latching stages outlined are applicable to the arrangements of both FIGS. 1A and 1B. FIG. 4A shows the probe 100, which is attached at the bow end 103 of the water vessel 101, in an extended orientation as shown in FIG. 2A. As outlined above, the insertion of the probe 100 into the block 200 may be assisted by utilizing a funnel-shaped guide member 205, as shown in FIGS. 1A and 1B. The probe 100 is traveling in a direction $X_1$ within the elongated opening 310 in the block 200. As shown, the diameter of the elongated opening 310 is slightly larger than the diameter of the probe 100, allowing the probe 100 to fit securely within the opening 310.

FIG. 4A shows the elements of head section 130 of the elongated probe 100 in a non-actuated orientation. Thus, the top cover 135, the contact cap 141, the push rod 147, the first separation ring 140, of the sensing and fuel regulating device 190, are positioned as shown in FIG. 2D. As outlined above, the contact cap 141 has an upper lip portion 143 which protrudes through the opening 139 at the top of the cover 135.

Similarly, FIG. 4A shows the elements of the block in a non-actuated position. Thus, the cylinder arms 358 and 368 are in an extended orientation with the cross-mounts 350 and 360 held away from rear end 305 of the fueling block 200. Additionally, the fuel-feeding cylinder 320, the valve arrangement 340, which includes the slidable cylindrical stopper 330, the spring 333, and the base ring 337, are positioned as illustrated in FIG. 3A.

FIG. 4B shows the probe 100 in a fully advanced position to the apex position 311 of the elongated opening 310 of the fueling block 200. When the probe advances as shown in FIG. 4B, the upper lip portion 143 of the contact cap 141 contacts the concave surface 325 of the fuel-feeding cylinder 320. The upper lip portion 143 also contacts the protrusion tip 335 of the slidable cylindrical stopper 330. This contact forces the contact cap 141 back in the direction $X_2$, opposite to $X_1$. As outlined above, plunger element 153 is initially biased toward the tip of the probe 100. However, when the contact cap 141 is pushed back in direction $X_2$, the spring bias is overcome and the plunger 153 is forced away from the tip towards the proximity sensor 151 in direction $X_2$. Thus, the plunger element 153 moves closer to the stationary proximity element 151. Because element 153 has moved to the location shown in FIG. 4B, the position of element 153 with respect to element 151 changes to a degree that indicates full insertion of the probe 100 within the opening 310.

FIG. 4D is a schematic illustration of a controller arrangement 400 according to an embodiment of the invention. The controller arrangement 400 is applicable to the parent ship/water vessel arrangements of both FIGS. 1A and 1B. FIG. 4D shows a controller 401, which receives a "full insertion" signal from the detecting arrangement (151, 153). Upon receipt of the signal, the controller 401 initiates the latching of the water vessel 101 to the fueling block 200. Although FIGS. 4A-4C do not illustrate the clamping/locking mechanisms, FIG. 3A illustrates clamping/locking elements 357, 370, and 375. The controller 401 actuates the first hydraulic cylinder 355, thereby retracting the arm 358, pulling the first cross-mount 350 towards the rear end 305 of the fueling block 200, as shown in FIG. 4B. As outlined above with respect to the illustration in FIG. 3A, when the hydraulic cylinder 355 retracts, the tines 357 push the plurality of spheres 375 along the channels 370 to engage and securely latch the elongated probe 100 within the block 200. Once securely locked, the water vessel 101 may be towed or serviced. The water vessel 101 may also be fueled.

If fueling is desired after the water vessel 101 is secured within the fueling block 200, an operator may initiate the fueling via an input device 410. The input device for initiating fueling may be remote to the water vessel 101 or the floating station 201, according to applicable embodiment of the invention. Upon initiation, fuel from the parent vessel 250 may be pumped to the fueling block 200 via the fuel port 380. Alternatively, fuel may be pumped to the fueling block 200 before an operator initiates the fueling of the water vessel 101. Because of the structural arrangement of the valve 320, in which the fuel-feeding openings 322 are blocked by the slidable cylindrical stopper 330, fuel is kept within the fueling block.

When the input device 410 sends the refueling command to the controller 401, the controller 401 actuates the second hydraulic cylinder 365, thereby retracting the arm 368, pulling the second cross-mount 360 towards the rear end 305 of the fueling block 200, as shown in FIG. 4C. When the second cross-mount 360 moves toward the fueling block 200, the valve arrangement 340 travels in direction $X_2$ and enters into the head portion 130 of the probe 100 through the opening 139 in the cover 135. As the valve arrangement 340 enters the probe 100, the valve arrangement 340 continues to push back the contact cap 141 in the direction $X_2$. The contact cap 141 continues to move in the direction $X_2$ until resistance from the spring 149 and the separation ring 140 prevent any further motion, leaving the cap 140 in a receded position.

As shown in FIG. 4C, when the contact cap 141 is in this receded position, the concave surface 325 of the fuel-feeding cylinder 320 maintains contact with the cap 141. However, because the push rod 147 is fixed and does not slide down with the contact cap 141, as the contact cap 141 slides into the receded position, the push rod 147 protrudes through the hole 144 in the cap 141. The push rod 147 then extends through the opening 327 at the top of the fuel-feeding cylinder 320. When the push rod 147 extends through the opening 327, the push rod 147 contacts the protrusion tip 335 of the cylindrical stopper 330, thereby pushing the cylindrical stopper 330 in the $X_1$ direction. As shown in FIG. 4C, when the stopper 330 is pushed back, the fuel-feeding openings 322 of the cylindrical fuel-feeding head 320 are unblocked, thereby allowing the fuel to flow through the one or more fuel-feeding openings 322 to the inside the probe 100. The fuel then flows from the head section 130 of the probe to the middle flow section 150 to the base section 170, and out of the probe 100. The fuel is then fed to the fuel collection device 180 via the hose 182 shown in FIGS. 1A and 1B.

When fueling is no longer desired, an operator may initiate the termination of fueling via the input device 410, which sends a termination signal to the controller 401. Alternatively, a sensing device 181 within the fuel collection device 180 may detect when the tank is full and send a termination signal to the controller 401. In response to a termination signal, the controller extends the cylinder arm 368, which moves the cross-mount 360 away from the rear end 305 of the fueling block 200. This motion moves the valve arrangement 340 in direction X1, so that the valve exits the probe 100. While exiting the probe 100, the slidable cylindrical stopper 330 moves away from the push rod 147. This motion away from the push rod 147 combined with a force of spring 333, pushes the stopper 330 so that the stopper protrusion 335 protrudes through the opening 327 of the fuel-feeding cylinder 320. Thus the slidable cylindrical stopper 330 covers the fuel openings 322 thereby terminating the flow of fuel.

In the FIG. 1A arrangement, when fueling is completed, an operator may choose to keep the water vessel 101 attached to the floating vessel 201 via the probe 100. Thus, the water vessel 101 may be maintained for further servicing, or may be towed by the floating station 201. Alternatively, an operator may decide to release the floating vessel 101 from the floating station 201. Similarly, in the FIG. 1B arrangement, when fueling is completed, an operator may choose to keep the water vessel 101 attached to the parent ship 250 by means of the fueling block 200 and the swinging arms 210. Again, the water vessel 101 may be maintained for further servicing, or may be towed by the parent ship 250, or the water vessel 101 may be released.

The water vessel 101 is released from the fueling block 200 when the operator sends a release signal via the input device 410, which is transmitted to the controller 401. In response, the controller 401 extends cylinder arm 358, which causes the cross-mount 350 to move away from the rear end 305 of the fueling block 200. In response to the motion by the cross mount 350, the spheres 375 retract and release the probe 100, disconnecting the water vessel 101 from the floating station 201.

Figure 5:
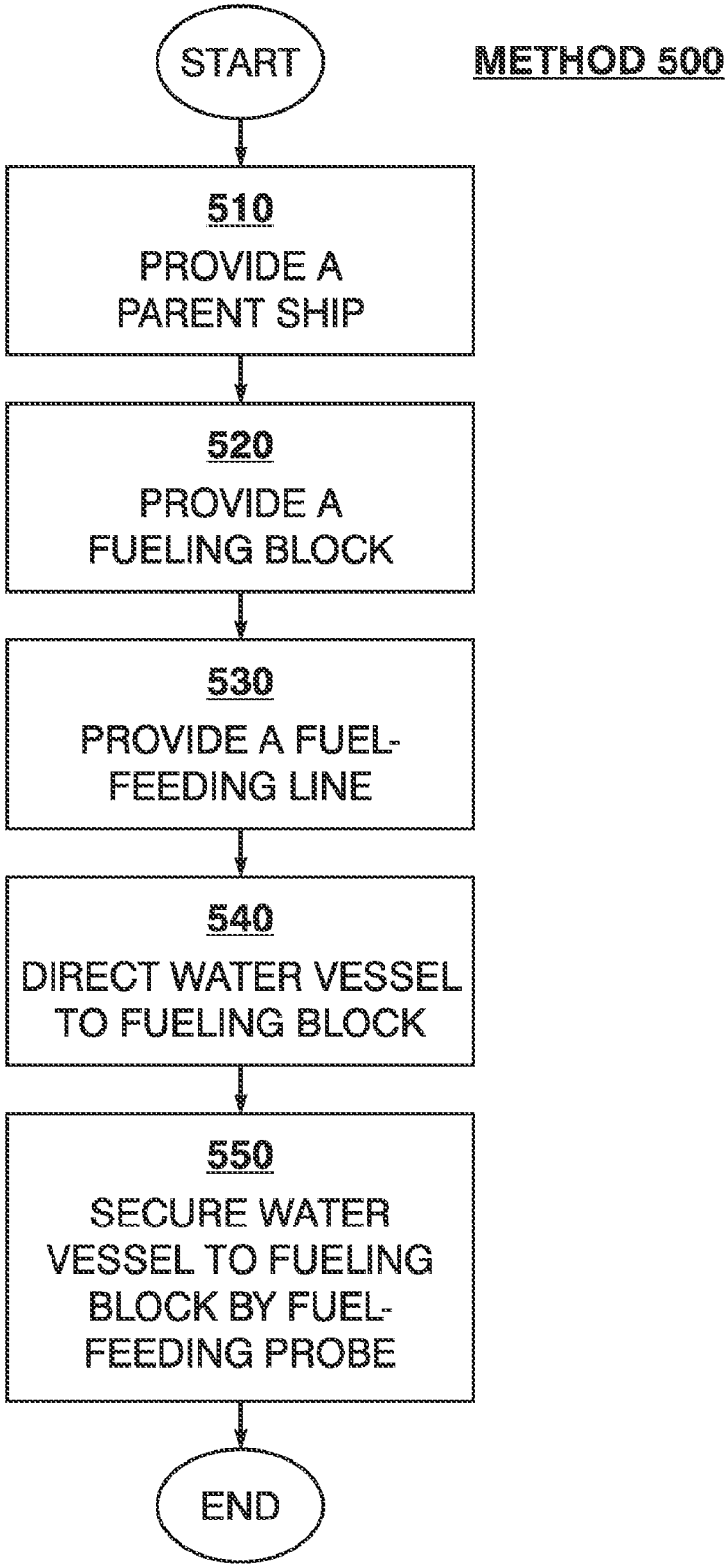
FIG. 5 is a flowchart illustrating a method of servicing a water vessel according to an embodiment of the invention.

FIG. 5 is a flowchart illustrating a method 500 of servicing a water vessel according to an embodiment of the invention.

The steps involved in the method 500 of servicing a water vessel have been outlined above in detail in the description with respect to FIGS. 1A-4D. The flowchart of FIG. 5 merely provides a broad overview of steps involved. Step 510 is the providing of a parent ship 250 with a fuel supply. As outlined above, the parent ship 250 may be a large water vessel, such as a sea base which transports smaller surface and subsurface vessels, including autonomous vessels and the like.

Step 520 is the providing of a fueling block 200, remote from the parent ship 250. As outlined above, the fueling block 200 may be positioned on the floating station 201, which may be a solid structure or an inflated structure, and may have any desired shape, such as for example, rectangular, oval; oblong, circular, or irregular. As shown in FIG. 1A, the floating station 201 may have a substantially V-shaped entry area 203. The fueling block 200 may also be attached to the parent ship 250 by means of swinging arms 210.

Step 530 is the providing of a fuel-feeding line 260 from the parent ship 250 to the fueling block 200. The fuel-feeding line 260 may be equipped with one or more valves 261 for controlling the flow of fuel to the fueling block and to the water vessel 101. The valves 261 may lock off the flow of fuel in circumstances when the conduit 260 fails, thereby preventing undue spillage of fuel into the surrounding water. Step 540 is the directing of the water vessel 101 to the fueling block 200. As shown in FIGS. 1A and 1B, the water vessel 101 is directed generally in direction 120. Step 550 is the securing of the water vessel 101 to the fueling block 200 by inserting the probe 100 into the block 200. When the fueling block 200 is on a floating station 201, as outlined above, the floating station 201 may have a substantially V-shaped entry, which helps to direct the water vessel 101 so that the probe 100 aligns with the fueling block 200. This is particularly beneficial when the water vessel 101 is a USV. Additionally, the fueling block 200 may include a funnel shaped device 205 to guide the probe 100 into the block 200. The water vessel 101 is secured to the fueling block 200 when the probe 100 is locked therewithin. Once secured, the vessel 101 may be fueled, with fuel pumped from the parent vessel 250 to the water vessel 101. Alternatively, once secured the water vessel 101 may be towed or other servicing operations may commence.

What has been described and illustrated herein are preferred embodiments of the invention along with some variations. The terms, descriptions and figures used herein are set forth by way of illustration only and are not meant as limitations. For example, elements of the invention may be exaggerated merely to illustrate the operation thereof. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A fueling system for securing and fueling a water vessel at a floating station, the fueling system comprising:

a parent ship for supplying fuel;

a fuel conduit having a first end and a second end, the fuel conduit attached to the parent ship at the first end;

a floating station remote from the parent ship, the second end of the fuel conduit attached to the floating station for transporting fuel from the parent ship to the floating station, the floating station having an opening for receiving a probe;

a water vessel comprising a probe, the probe positioned within the opening of the floating station, the probe receiving fuel from the parent ship via the fuel conduit and the floating station, wherein the floating station comprises a fueling block in which the opening is formed, the fueling block further comprising:

a clamping arrangement securing the probe in the opening;

a fuel-feeding cylinder within the fueling block, the fuel-feeding cylinder connected to the fuel conduit from which the fuel-feeding cylinder receives fuel, the fuel-feeding cylinder movable into the probe to deliver fuel thereto;

the fueling system further comprising:

a controller; and a detecting arrangement positioned within the probe detecting when the probe is fully inserted into the fueling block opening, the detecting arrangement connected to the controller, signaling to the controller when the probe is fully inserted, wherein when the controller receives a signal from the detecting arrangement that the probe is fully inserted in the fueling block opening, the controller initiates the latching of the probe therewithin, wherein the fuel-feeding cylinder comprises;

one or more fuel-feeding holes for supplying fuel to the probe; and a valve arrangement within the fuel-feeding cylinder, the valve arrangement comprising a spring tensioned cylindrical stopper slidable within the fuel-feeding cylinder to block and to unblock the one or more fuel-feeding holes.

2. The fueling system of claim 1, wherein the fueling block further comprises:

a first pair of hydraulic cylinders; and a second pair of hydraulic cylinders, the first pair of hydraulic cylinders is connected to the clamping arrangement to latch and to unlatch the probe within the fueling block opening, and wherein the second pair of hydraulic cylinders is connected to the fuel-feeding cylinder to move the fuel-feeding cylinder into and out of the latched probe.

3. The fueling system of claim 1, wherein the probe includes a head section for receiving the fuel-feeding cylinder, the head section having a push rod, wherein when the fuel-feeding cylinder moves into the head section, the push rod contacts the spring tensioned cylindrical stopper, thereby pushing the cylindrical stopper away from the one or more fuel-feeding holes, thereby allowing fuel to be fed from the fuel-feeding cylinder into the probe.

4. The fueling system of claim 3, wherein the detecting arrangement includes a fixed element and a movable element, both positioned within the push rod.

5. The fueling system of claim 4, wherein the water vessel is an unmanned surface vessel.

* * * * *